United States Patent [19]

Korchin

[11] 4,403,923

[45] Sep. 13, 1983

[54] SUBMERSIBLE PUMP

[76] Inventor: Herbert P. Korchin, 32 Friendship Ct., Red Bank, N.J. 07701

[21] Appl. No.: 262,925

[22] Filed: May 12, 1981

[51] Int. Cl.[3] ..... F04B 39/14

[52] U.S. Cl. ..... 417/360

[58] Field of Search ..... 417/360, 361, 234; 285/401, 376, 360

[56] References Cited

U.S. PATENT DOCUMENTS 3,143,971 8/1964 Green ..... 417/360

3,172,365 3/1965 Nasvytis ..... 417/360

*Primary Examiner*—Richard E. Gluck

*Assistant Examiner*—Peter M. Cuomo

*Attorney, Agent, or Firm*—Weingram & Klauber

[57] ABSTRACT

A submersible pump having a volute fixedly connected to the discharge conduit, and a motor housing detachably connected to the volute. The impeller is coupled to the motor mounted within the motor housing, which housing has a flange adapted to fit over the top of the volute, and mate with a corresponding flange on the volute. To fix the motor housing to the volute, guide members on the volute are inserted into slots in the motor housing flange, and the motor housing twisted in one direction to engage the guide members with the slots. Twisting the motor housing in the opposite direction releases the guide members permitting the motor housing with the motor and pump impeller to be removed from the volute for servicing. A handle is provided to twist the motor housing to engage and disengage it from the volute and with which the motor and pump impeller may be lifted out of and off the volute.

To facilitate release of the guide members, the volute flange is provided with apertures, and the volute with receptacles, for inserting a tool such as a screwdriver or pipe to loosen the motor housing flange from the volute.

5 Claims, 7 Drawing Figures

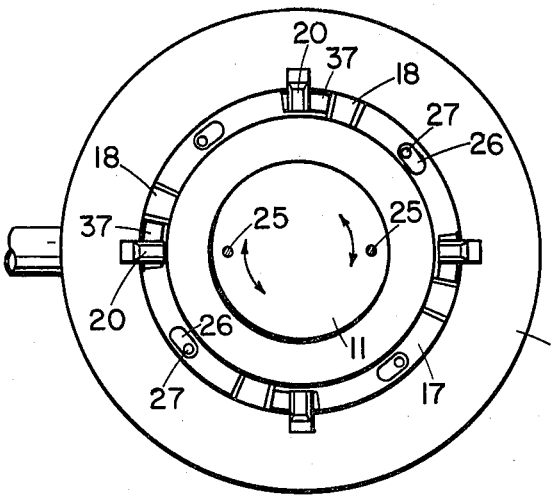
Fig. 3
Fig. 4A
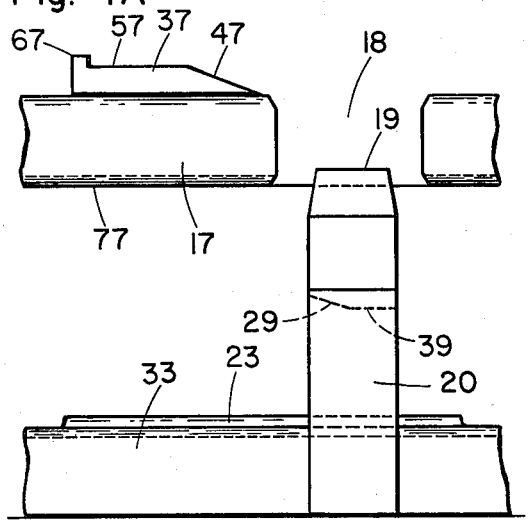
Fig. 4B
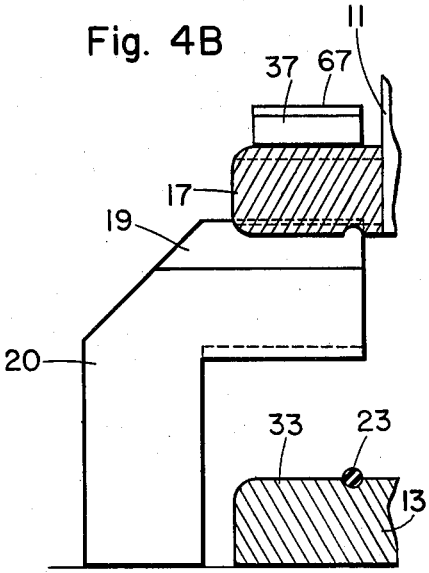
Fig. 5A
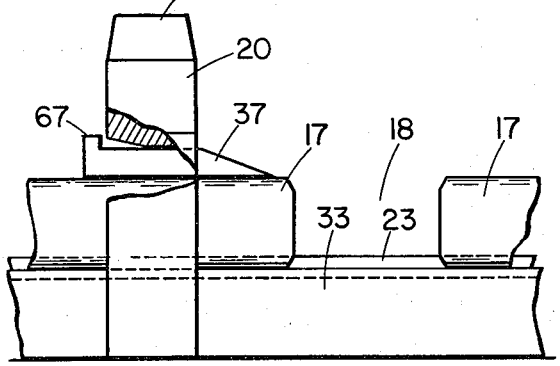
Fig. 5B
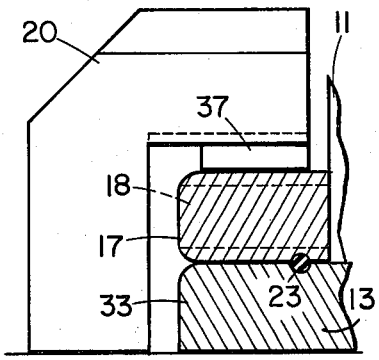

SUBMERSIBLE PUMP

BACKGROUND OF THE INVENTION

1. Field of the Invention

This invention relates to submersible pumps for moving liquids such as waste liquids and sewage which pumps are housed in a pit and submerged in the liquid. In particular, the invention relates to a means of quickly and easily disengaging the working parts of the pump from its associated discharge piping for servicing and cleaning of the pump.

2. Prior Art

Submersible pumps have been in use for a long time to remove waste liquids by draining the liquid into a pit or enclosure in which the pump is located, and discharging the waste liquid through a discharge pipe or conduit connected to the output of the pump. Heretofore, when the pump required servicing, e.g., cleaning because a foreign object had lodged in the pump or discharge opening and prevented normal operation, it had to be lifted from the pit. Therefore, someone had to disconnect the pump from the discharge pipe by entering the pit and removing bolts or other connections to allow the pump to be lifted out.

Needless to say, it is a disagreeable task for someone to climb down into a pit of waste liquids and disassemble the pump to permit its removal. To avoid this problem, it has been proposed, as described in U.S. Pat. No. 3,592,564 to provide the pump discharge opening with a flexible seal which is forced into sealing engagement with the adjacent flange of the discharge pipe when the pump is in service. This required precise alignment of the pump discharge opening and the adjacent flange of the discharge pipe when the pump was lowered into the pit.

This problem was solved, as described in the patent, by providing a vertical guide rail which allowed the entire pump to be lifted out for servicing and placed back into position. As will be appreciated by those skilled in this art, such installations are more expensive because they require the installation of a guide rail and a larger size diameter pit in order to accommodate the guide rail. These installations also require great care when lifting the pump out and repositioning it, because of the accuracy of alignment required, as discussed above.

SUMMARY OF THE INVENTION

The present invention provides a pump having a volute and a removable motor housing mounted on the volute. The motor housing houses the motor which is coupled to and drives an impeller. By disengaging the motor volute, the motor and impeller are lifted off the housing and can be lifted out of the pit or pump enclosure for servicing. The volute has a discharge opening which is permanently connected to the pipe or conduit forming a part of the discharge system.

To ensure a proper fit, or connection of the motor housing, the volute is provided with guide members which register with corresponding slots in a flange of the motor housing. By twisting the motor housing, the guide members can be disengaged from the motor housing flange to enable the motor and impeller to be lifted from the volute. Similarly, twisting the motor in the opposite direction will engage the motor housing flange with the guide members and securely position the motor and impeller on and in operative relationship with the volute.

To facilitate removal of the motor and impeller for servicing, or to remove an object blocking the discharge opening in the volute, the motor housing is provided with a handle with which the motor housing including the motor and impeller can be lifted out, either manually or, for large installations, with the aid of a winch or the like.

To further facilitate the release of the guide members in the event that the motor housing flange becomes fixed or frozen to the volute, the motor housing flange may be provided with slots aligned with apertures in the volute. By inserting a tool, such as a screwdriver, rod or even a piece of pipe, into the slot and aperture, enough leverage may be gained to twist the motor housing flange and disengage it from the guide members.

It will thus be seen that no vertical rail is required to guide the motor and impeller into the volute. It is simply necessary only to lower the motor and impeller into the volute while aligning the guide members with the slots in the motor housing flange and then to twist the motor housing to engage firmly the guide members and the motor housing flange.

The discharge opening in the housing is undisturbed and remains undisturbed during removal and replacement of the motor and impeller. Should there be a foreign object blocking the volute opening, it can easily be removed when the motor and impeller are lifted out by using a stick or similar tool from above the pit. It is not necessary for anyone to enter the pit to loosen bolts, or to clean out the volute.

Accordingly, it is an object of the present invention to provide a submersible pump which is easily disassembled for servicing and cleaning.

It is a further object of the present invention to provide a submersible pump requiring no vertical rails for guiding the pump into position for connection to a discharge conduit.

It is a still further object of the present invention to provide a submersible pump which is more readily accessible for servicing and cleaning.

Another object of the present invention is to provide a submersible pump in which the discharge opening is not disturbed during servicing yet which is readily accessible for cleaning.

Yet another object of the present invention is to provide a submersible pump which is simpler an less costly to construct and assemble.

Still another object of the present invention is to provide a submersible pump which will be more reliable in operation and require less time for servicing.

Yet another object of the present invention is to provide a submersible pump which requires a minimum of accessory equipment to facilitate servicing and therefore can operate in a relatively small diameter pit.

A further object of the present invention is to provide a submersible pump which can be disassembled for servicing without having to enter the pit.

Yet another object of the present invention is to provide a submersible pump which can be disassembled from a point remote from the operating level of the pump.

Further objects and advantages of this invention will be apparent from the more detailed description of an illustrative embodiment which follows with the novel features of the invention being pointed out in the appended claims.

BRIEF DESCRIPTION OF THE DRAWINGS

The invention will be described in more detail in connection with an illustrative embodiment shown in the accompanying drawings in which:

FIG. 3 is a top plan view of the pump looking down from the line 3—3 in FIG. 1;

FIGS. 4A and 4B, respectively, are front and side views of the motor housing flange and volute disconnected showing the guide member.

FIGS. 5A and 5B, respectively, are front and side views of the motor housing flange and volute held in engagement by the guide member.

DETAILED DESCRIPTION OF THE ILLUSTRATIVE EMBODIMENT

Figure 1:
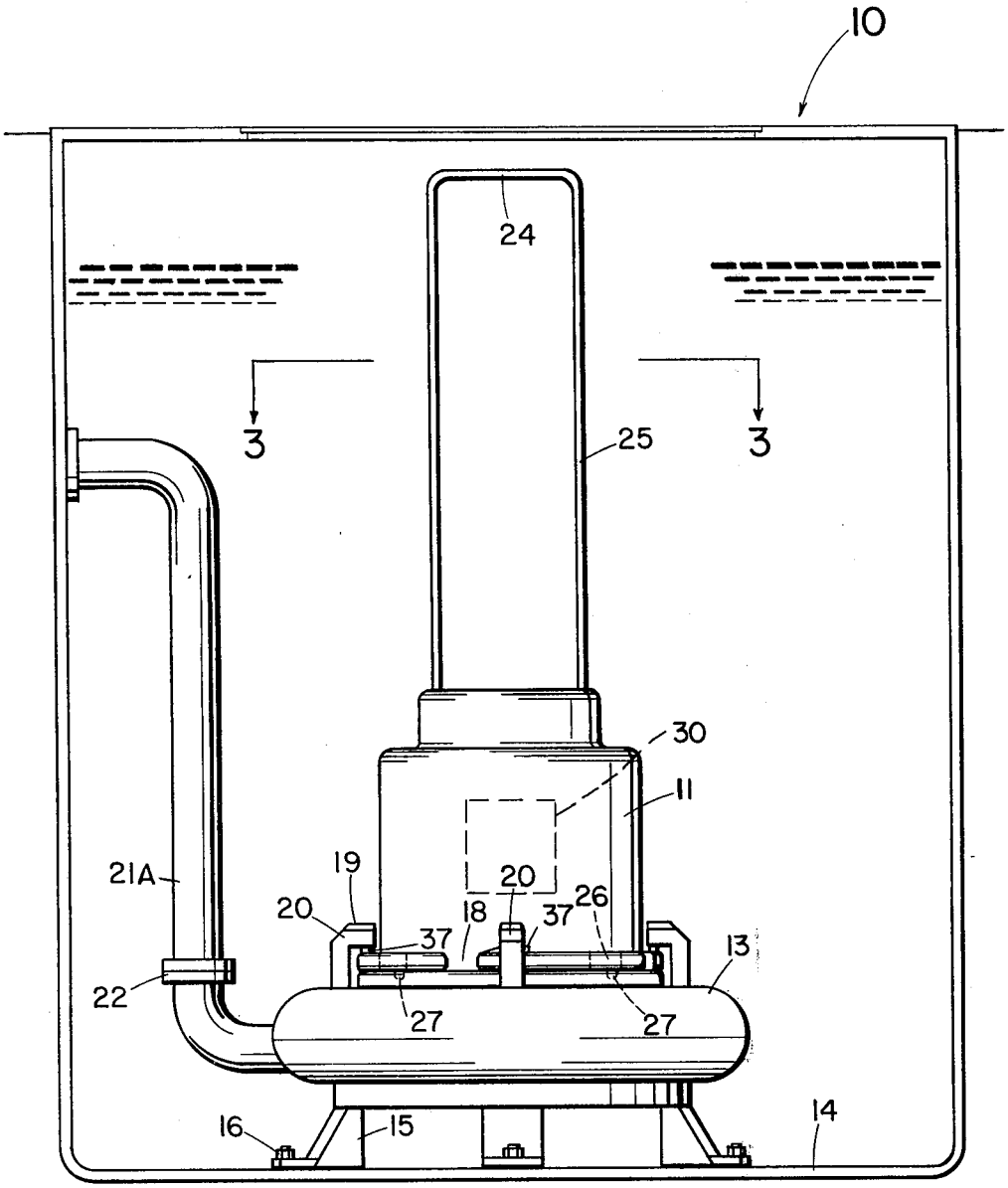
FIG. 1 is an elevational view of the pump according to the invention.
Figure 2:
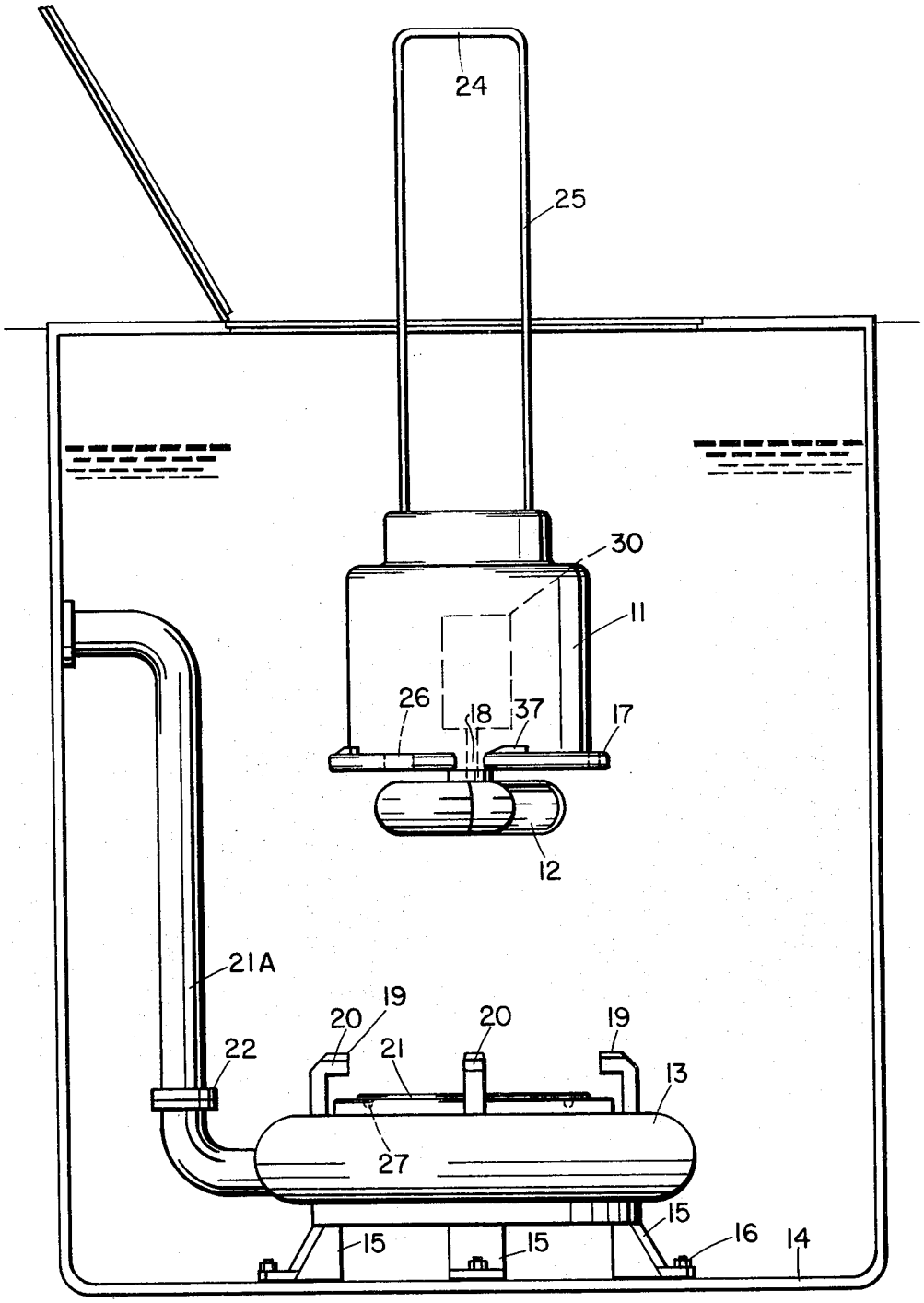
FIG. 2 is an elevational view of the pump with motor and impeller lifted out of the housing.

The pump, according to the present invention, is fully submersible and, as illustrated in the drawing, is located in a pit 10, or similar enclosure. The pump includes a motor housing 11 enclosing a motor 30 which is coupled to and drives an impeller 12 (FIG. 2) which is positioned in a volute 13. The volute and the entire pump are mounted on the floor 14 of the pit by brackets 15 which are bolted to the floor and secured by nuts 16.

Motor housing 11 has a motor housing flange 17 extending from the bottom of the motor housing. The motor housing flange 17 has a series of slots 18 in it disposed about the circumference of the flange which are angularly displaced to register with a plurality of guide members 19 connected to the volute and extending up from the volute by means of brackets 20.

The motor housing flange 17 has an engaging head 37 located to the left of each space 18 in the flange. The engaging head consists of a camming surface 47 and a contacting portion 57, which is generally horizontal in nature, and a stop 67 which is a raised portion protruding above the contacting surface 57.

The contacting surface 57 is adapted to contact the contacting surface 39 on the underside of guide member 19 which also has a camming surface 29 adapted to coact with the camming surface 47 on the engaging head from the motor housing flange 17.

As will be readily apparent, the motor housing flange 17 can be placed over the volute and easily twisted until the guide members 19 are in registration with the spaces 18 in the motor housing flange 17. The motor housing flange will then drop down until the bottom surface 77 of the motor housing flange 17 will contact the top surface 33 of the volute 13. An O-ring 21 positioned in a groove in the top surface 33 of volute 13 is adapted to engage with the bottom surface 77 of motor housing flange 17 in order to seal the motor housing flange with the contacting surface 33 of volute 13.

Once the motor housing flange 17 has been lowered onto the top of volute 13, twisting or rotation of the motor housing 11 in a counter-clockwise direction will bring the camming surfaces 29 of the guide members into co-action with the camming surfaces 47 of the engaging heads 37 on the motor housing flange 17 to force the flange down against the top 33 of the volute 13 and cause the O-ring 21 to seal the motor housing flange 17 with the volute 13. Obviously, any other convenient sealing means, such as a gasket, could also be used.

Additionally, it should be pointed out that since this is a submersible pump, any minor leakage that may occur between the motor housing flange 17 and the contacting surface 33 of the volute 13 would be of little consequence since this would just be a small recirculation of the water to be redischarged by the pump.

The volute 13 containing the impeller 12 is connected to a discharge conduit 21A by means of a fixed flange coupling 22 which remains permanently connected, and does not have to be disconnected to remove the pump. Of course, it may be disconnected to replace the conduit.

To remove the pump, a handle 24 having vertical side members 25 connected to the housing 11 is twisted to rotate the housing until the contacting surfaces 57 and 39 on the motor housing and guide means, respectively, are disengaged and the guide means 19 register with the slots 18 in the motor housing flange. The motor housing is them lifted free. For small pumps, this may be done manually; for larger pumps a winch may be attached to the handle to lift the motor housing.

To facilitate rotation of the housing flange 17 relative to the guide members 19, flange 17 is provided with auxilliary slots 26 in the motor housing 11 aligned with apertures 27 in volute 13. Insertion of a tool such as a screwdriver, or even a pipe, in the slot and aperture, preferably one each on opposite sides of the housing, will provide additional leverage to aid in turning flange 17 relative to the volute, to free the motor housing.

If desired, the guide members also may be provided with a wedge-like member which could be actuated by the handle to free the guide members.

Thus, to remove the impeller for servicing and clean-out of the pump, the motor housing is rotated to disengage the guide members from the engaging heads of flange 17, and the motor housing is lifted up out of the pit. A foreign object obstructing the discharge opening can easily be removed with a long stick or similar tool, and the impeller cleaned while out of the pit.

To reassemble the pump, the motor housing 11 and impeller are lowered onto the volute. The guide members align with the slots and serve to guide the housing into proper relationship with the volute. The housing is rotated and the coacting surfaces of the guide means and motor housing flange 17 secure the motor housing flange to the volute. No one has to enter the pit to loosen or fasten bolts or other fittings, or to clean the volute.

Note also that the normal torque forces exerted by the motor tend to hold the motor housing in operative relationship to the volute. When looking down at the top of the pump, the impeller normally turns clockwise, so that the motor exerts a counter clockwise torque urging the motor housing counterclockwise with respect to the volute. This is also the direction that the motor housing is turned to engage the guide members with the engaging heads to secure the motor housing to the volute. Therefore, the housing and volute are held in engagement by the motor forces.

While the invention has been described in connection with the illustrated embodiment, other modifications will be readily apparent to those skilled in this art without departing from the scope of the invention as defined in the appended claims.

What is claimed is:

1. A submersible pump comprising:

a volute having a discharge conduit connected thereto;

a motor housing having a motor therewithin, said motor coupled to an impeller;

said motor housing further including a flange thereon having slots therein;

guide means extending from said volute aligned with and to extend into said flange slots;

means adjacent on said flange adjacent said slots for engaging said guide means;

said engaging means and said guide means coacting to secure said motor housing to said volute;

said engaging means and said guide means including coacting camming means and contact surfaces operative upon movement of said motor housing relative to said volute;

sealing means between the motor housing flange and the volute;

levering means, comprising a slot in said flange and an aperture in said volute aligned with said slot, into which a tool can be inserted to loosen said flange from said volute;

motor housing twisting means comprising a handle on the side of the motor housing remote from the volute to twist said motor housing relative to said volute so as to engage or disengage said motor housing from said volute.

2. A submersible pump comprising:

a volute having a discharge conduit connected thereto;

an impeller coupled to a driving means for moving a fluid within said volute to said discharge conduit;

a housing for said drive means including a flange having slots therein;

guide means including camming means disposed on said volute aligned with said flange slots and adapted to fit into the slots; and means on said flange adjacent said slots adapted to engage said guide means and releasably secure said volute to said housing upon rotation thereof, levering means comprising a slot in said flange and an aperture in said volute aligned with said slot, being adapted to receive a tool to assist in loosening the flange from the volute during rotation thereof.

3. A submersible pump as claimed in claim 2 wherein said camming means include coacting cam means and surfaces on said guide means and said engaging means operative upon rotation of said housing relative to said volute to release said housing from said volute.

4. A submersible pump as claimed in claim 3 including a handle on said housing for rotating said housing to secure and release said housing to and from said volute.

5. A submersible pump as claimed in claim 4 further including sealing means between said flange and said volute.

* * * * *